US009496076B2

(12) United States Patent
Wosinski

(10) Patent No.: US 9,496,076 B2
(45) Date of Patent: Nov. 15, 2016

(54) CABLE GROMMET FITTING APPARATUS FOR CABLE

(71) Applicant: SCHLEUNIGER HOLDING AG, Thun (CH)

(72) Inventor: Eugen Wosinski, Pfaeffikon (CH)

(73) Assignee: SCHLEUNIGER HOLDING AG, Thun (CH)

( * ) Notice: Subject to any disclaimer, the term of this patent is extended or adjusted under 35 U.S.C. 154(b) by 554 days.

(21) Appl. No.: 13/711,645

(22) Filed: Dec. 12, 2012

(65) Prior Publication Data

US 2013/0104391 A1 May 2, 2013

Related U.S. Application Data

(63) Continuation-in-part of application No. PCT/IB2011/052252, filed on May 24, 2011.

(30) Foreign Application Priority Data

Jun. 16, 2010 (EP) ..... 10166167

(51) Int. Cl.
*H01R 43/00* (2006.01)
*H01B 19/00* (2006.01)

(52) U.S. Cl.
CPC ..... *H01B 19/00* (2013.01); *H01R 43/005* (2013.01); *Y10T 29/53209* (2015.01)

(58) Field of Classification Search
USPC ..... 29/747–756
See application file for complete search history.

(56) References Cited

U.S. PATENT DOCUMENTS 4,521,946 A * 6/1985 Dusel ..... B65G 15/14 29/33 M
4,586,768 A 5/1986 Eck
4,653,182 A 3/1987 Fukuda et al.
5,016,346 A 5/1991 Gerst et al.
5,063,656 A * 11/1991 Hirano ..... H01R 43/28 29/33 M
5,284,001 A 2/1994 Ochs (Continued)

FOREIGN PATENT DOCUMENTS

CA 2254017 A1 5/2000
CA 2254057 A1 5/2000

(Continued)

OTHER PUBLICATIONS

Copending commonly-owned C-I-P continuation-in-part U.S. Appl. No. 14/073,896, filed Nov. 7, 2013.

(Continued)

*Primary Examiner* — Peter DungBa Vo
*Assistant Examiner* — Kaying Kue

(57) ABSTRACT

A cable processing machine has cable grommet fitting apparatus 1*a*, 1*b* fitting cable grommets 2 onto a cable. The grommet fitting apparatus includes a loose material container 3 for receiving a plurality of loose cable grommets 2, a conveyor separating the cable grommets 2 located in the loose material container and conveying the separated cable grommets 2 to a mounting location. The machine includes a grommet mounter 8 mounting the conveyed cable grommets 2 onto cable. The conveyor includes a continuous, annular conveyor 4, 4*a*, 4*b* protruding into the loose material container 3 as well as a grommet receiver 6 receiving and raising the cable grommets 2. Grommet receivers 6 may be arranged on the inside of the conveyor ring.

20 Claims, 13 Drawing Sheets

(56) References Cited

U.S. PATENT DOCUMENTS

Figure 1:
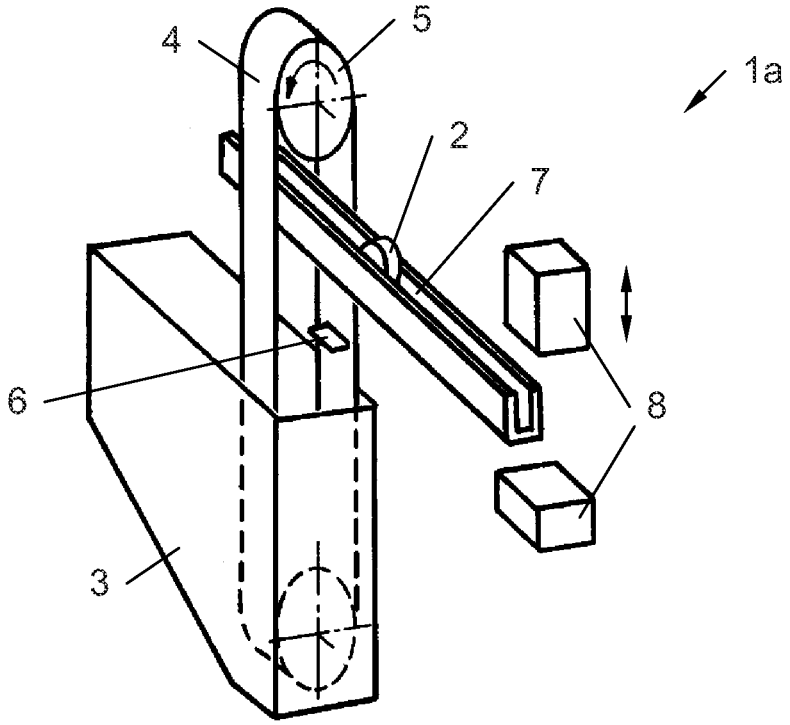

| | | | | |
|---|---|---|---|---|
| 5,315,757 | A | 5/1994 | Koch et al. | |
| 5,333,374 | A * | 8/1994 | Pittau | H01R 43/20 29/33 M |
| 5,392,505 | A | 2/1995 | Harada | |
| 5,432,996 | A * | 7/1995 | Imgrut | H01R 43/005 29/235 |
| 5,456,148 | A * | 10/1995 | Hoffa | H02G 1/1256 198/626.4 |
| 5,465,478 | A * | 11/1995 | Anderson | H01R 43/28 242/443 |
| 5,732,750 | A * | 3/1998 | Soriano | H01R 43/28 140/92.1 |
| 5,903,970 | A | 5/1999 | Pittau | |
| 5,913,553 | A * | 6/1999 | Takada | H01R 43/01 29/33 F |
| 6,276,564 | B1 | 8/2001 | Reich | |
| 6,336,267 | B1 * | 1/2002 | Hoffa | H02G 1/1256 29/33 M |
| 6,738,134 | B2 | 5/2004 | Maeda | |
| 6,763,574 | B1 * | 7/2004 | Woll | H01R 43/055 29/33 M |
| 6,990,730 | B2 * | 1/2006 | Fujita | H01R 43/20 269/903 |
| 7,047,618 | B2 * | 5/2006 | Hunter | B23P 19/084 29/229 |
| 7,363,703 | B2 | 4/2008 | Imgrut | |
| 2003/0007774 | A1 | 1/2003 | Christopher et al. | |
| 2003/0009869 | A1 | 1/2003 | Strandberg et al. | |
| 2005/0108872 | A1 * | 5/2005 | Konrath | H05K 13/0061 29/831 |
| 2010/0310210 | A1 | 12/2010 | Murayama et al. | |

FOREIGN PATENT DOCUMENTS

| | | | |
|---|---|---|---|
| DE | 19901439 | C1 | 2/2000 |
| EP | 0462923 | B1 | 12/1991 |
| EP | 0533045 | A2 | 3/1993 |
| EP | 0533045 | A3 | 7/1993 |
| EP | 0626738 | B1 | 12/1997 |
| EP | 0881720 | B1 | 9/2002 |
| EP | 1022821 | B1 | 1/2004 |
| EP | 1912296 | A1 | 4/2008 |
| EP | 1689049 | B1 | 11/2008 |
| GB | 412859 | A | 7/1934 |
| GB | 1379964 | A | 1/1975 |
| JP | H09-171878 | A | 6/1997 |
| JP | 2000-184542 | A | 6/2000 |
| JP | 2004-014278 | A | 1/2004 |
| JP | 2005-166297 | A | 6/2005 |
| JP | 2009-042022 | A | 2/2009 |
| WO | 2011/158145 | A1 | 12/2011 |

OTHER PUBLICATIONS

Copending commonly-owned U.S. Appl. No. 14/024,873, filed Sep. 12, 2013.

International Search Report and written opinion, dated Aug. 29, 2011, from parent International Application PCT/IB2011/052252 published as WO2011/158145A1 on Dec. 22, 2011, with full English translation.

EPO search report and written opinion from priority EPO application EP10166137, dated Oct. 12, 2010, in German.

Second (affirmation) Notice of Allowance dated Nov. 5, 2015 in C-I-P U.S. Appl. No. 14/073,896.

Notice of Allowance dated Oct. 7, 2015 in C-I-P U.S. Appl. No. 14/073,896.

* cited by examiner

CABLE GROMMET FITTING APPARATUS FOR CABLE

This application is a Continuation-In-Part (CIP) of copending PCT International application no. PCT/IB2011/052252 filed on May 24, 2011 and published as WO2011/158145A1 on Dec. 22, 2011, which in turn claims benefit of priority to prior European (EPO) application no. EP10166167 filed on Jun. 16, 2010; the entirety of parent PCT International application no. PCT/IB2011/052252 is hereby expressly incorporated herein by reference, in its entirety and as to all its parts, for all intents and purposes, as if set forth identically in full herein.

The invention relates to an apparatus for fitting cable grommets onto a cable, including a loose material container holding a plurality of loose cable grommets, a conveyor configured to separate the cable grommets located in the loose material container and to convey them to a mounting location, as well as a mounting device configured to mount the conveyed cable grommets onto the cable.

In the manufacture of cables and/or cable harnesses, cable grommets frequently must be fitted. In this case, the cable grommets are mounted on cable by a known mounting tool. In order to permit efficient production, both the cable and the cable grommets are continuously conveyed to the mounting location and/or the mounting tool. To accomplish this, a loose material container is conventionally filled with cable grommets to be processed, and from there the cable grommets may be removed as required. Certain separating devices are known from the prior art, these separating devices removing the cable grommets from the loose material container and supplying them to the mounting tool in an ordered manner, that is, in sequence.

For example, prior patent EP 1 689049 B1 discloses a device for fitting grommets to electrical cables. It consists of a base module for carrying both a grommet module and a grommet fitting module, the grommet module providing the grommets to be fitted in the correct position relative to the grommet fitting module, and the grommet fitting module fitting the cables with the grommets. In this example, the grommet module consisting of a grommet store and a conveying device is attachable to the base module in a pluggable manner.

A drawback with this prior solution is that the drum conveyer employed is relatively bulky and thus the machine for fitting the grommets requires a relatively large footprint.

In addition to the disclosure in EP 1689049 B1 for fitting grommets to electrical cables, devices are also known that have a suction-blowing conveyor for separating and conveying cable grommets. However, such conveyors are relatively noisy and require a comparatively large amount of energy for operation.

The present invention relates to provision of improved apparatus for fitting cable grommets onto a cable, in particular apparatus that is compact, quiet and energy-efficient. Advantages may be derived by providing an apparatus in which the conveying device includes:

- a continuous, annular conveyor protruding into the loose material container, as well as,
- a receiver for receiving the cable grommets, this receiver being arranged on the conveyor on the inside of an annular ring.

Compared to a prior suction-blowing conveyor, for example, the present separator has the advantage of considerably reduced noise development and considerably reduced energy consumption. Furthermore, when compared to the prior a drum conveyor, the present separator has the advantage of a considerably reduced space requirement. Accordingly, the present separator is particularly well-suited to a cable grommet fitting apparatus. Additional advantages of versions and developments of the invention shall be evident or revealed from the present description, in conjunction with the drawings.

It is advantageous if at least one roller is arranged on the inside of a ring formed by the conveyor, and around which roller the conveyor is guided. Advantageously, therefore, a frictional force may be kept low when the conveyor is moved. Additionally, the aforementioned roller may be provided as a counter-roller of a drive roller pressing onto the conveyor from the outside, so that the drive force is efficiently transmitted to the conveyor.

Advantageously, a plurality of rollers may be arranged on the inside of the ring formed by the conveyor, so that the conveyor is guided around these rollers, with at least two of the rollers being arranged on the inside of the ring formed by the conveyor and being vertically spaced apart. In this arrangement, a frictional force of conveyor movement may be reduced even further relative to the aforementioned variant.

Advantageously, at least one of these rollers may be driven and configured as a friction roller and/or as a friction wheel. The drive may be implemented particularly easily in this variant, as only one smooth and/or weakly structured conveyor and a smooth and/or weakly structured drive roller are required. Additionally, the drive roller is able to slip in the event of overload, so that damage to the drive motor or a gear mechanism located between the drive roller and the drive motor may be avoided.

It may also be further advantageous if at least one of the rollers be driven and configured as a spiked roller, spiked wheel and/or spiked cylinder or gearwheel. In this manner, a positive connection may be created with the conveyor. In this case, it may be advantageous that the contact forces of the roller on the conveyor are not required to be as high as with a friction wheel. Thus the mounting of the roller may be designed as less robust. Also, due to reduced bearing forces, smaller drive motors may be employed. With reduced contact forces, the risk of injury may also be reduced if an operator of the machine should inadvertently come between the conveyor and the drive roller. Additionally, via the positive connection a movement of the drive roller may be assigned directly and specifically to a movement of the conveyor. This provides advantages if a position of the conveyor is to be determined, for example, from the signal of a step motor or rotation sensor. It should also be mentioned that with a positive drive connection, a contamination of the drive roller or the belt, even oil contamination, is not as easily able to cause a malfunction of the machine.

In order to produce this positive drive connection, for example, the spikes of a spiked roller may engage in recesses in an annular conveyor, in a relation somewhat similar to that between a drive roller of a film projector and the recesses in film material. In this case, the spiked roller may be arranged inside, or even outside, the ring formed by the conveyor. Alternatively, the positive connection may also be produced by a gearwheel which engages in a toothed portion of the conveyor. To this end, such gearwheel may be at least partially configured in the manner of a toothed belt. The gearwheel may be arranged as the toothed portion of the conveyor inside, or even outside, the ring formed by the conveyor.

It may be particularly advantageous if:

instead of the at least one driven roller in engagement with the conveyor, a drive roller in engagement with a continuous, annular drive is provided, and, the annular drive is at least partially in engagement with the conveyor on the outside of the conveyor ring.

In this manner, the drive is displaced on the side of the conveyor on which no grommet receivers are arranged, namely on the outside of the ring of the conveyor. However, high frictional forces may be transmitted in this manner. A positive connection between the drive roller and conveyor—albeit conceivable in principle—is generally not necessary. In this variant, the separating device may potentially be designed to be of simpler construction. For example, a narrow drive belt may be combined with a broader conveyor.

It may also be advantageous if a further roller is arranged relative to a driven roller in engagement with a conveyor, or relative to a drive roller engaged with a continuous, annular drive. In this manner, the contact pressure of a drive roller on the conveyor/drive may be increased and/or the conveyor/drive may be guided in an improved manner via the drive roller. The additional roller may, in this case, be either freewheeling or also driven.

It may also be particularly advantageous if the conveyor is guided in a rail, so that rollers arranged inside the ring formed by the conveyor, via which the conveyor is guided, may be dispensed with. In particular, when such rollers are eliminated, practically the entire width of the conveyor may be used for the grommet receiver, as a bearing surface for rollers does need not be provided.

It may also be advantageous if a horizontal or oblique conveying portion that protrudes into the inside of the aforementioned ring is provided. In such variant, the cable grommets fall, in the region of the upper dead center point of the conveyor, onto the additional conveying portion and are transported thereby to the mounting point already in separated form. Advantageously, one or more of the group of: a conveyor belt, a slide, or a vibrator; are provided as this conveying portion. The conveying portion most suitable may be provided, depending on the type of cable grommets to be separated and the transport path to the mounting point.

It is also advantageous if one or more of the group of: a belt, strap, cable, or chain; are provided as the conveyor. Depending on the type of receivers that are fastened to the conveyor, and depending on the type of drive, the conveyor that appears most suitable may be provided in this variant.

It is also advantageous if one or more of the group of: a blade, fork, pin, or plate; are provided for grommet receiver. Depending on the type of cable grommets to be separated, the receivers that appear most suitable may be provided in this variant.

Finally, it may be advantageous if the conveyor includes a belt of resilient plastics or rubber with blades made of plastic arranged thereon. It may be particularly advantageous in this case if the blades are adhesively bonded or riveted to the belt. In this manner, the belt may be produced in a simple manner and/or even a conventional belt actually originally intended for a different purpose may be arranged with the blades or plates. If the belt is of rubber or resilient plastics, it is additionally possible to compensate for tolerances of the belt or the mounting thereof.

It should be understood that the previously indicated versions, variants, and developments of the invention may be combined in any manner. It should be pointed out that the variants set forth only represent a proportion of the many possibilities for the invention and should not be used to limit the field of application of the invention.

Figure 2:
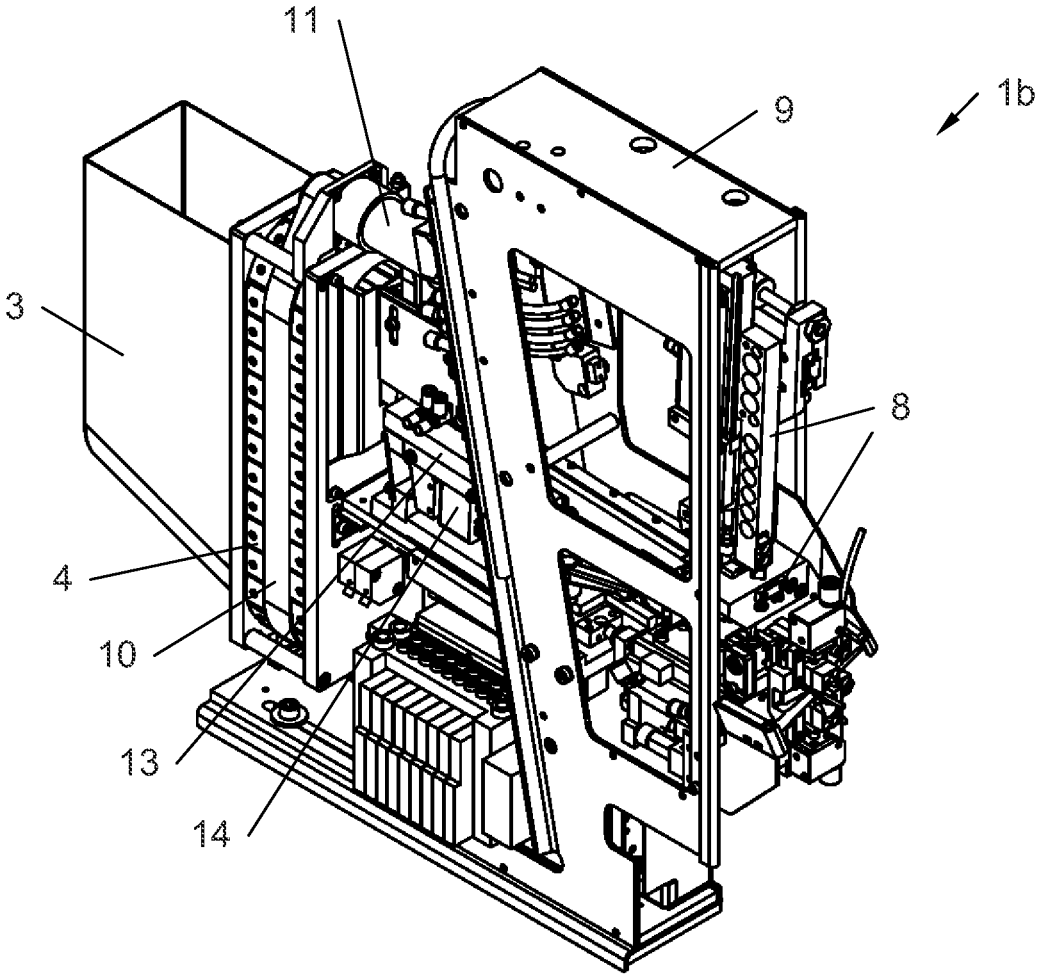
Figure 3:
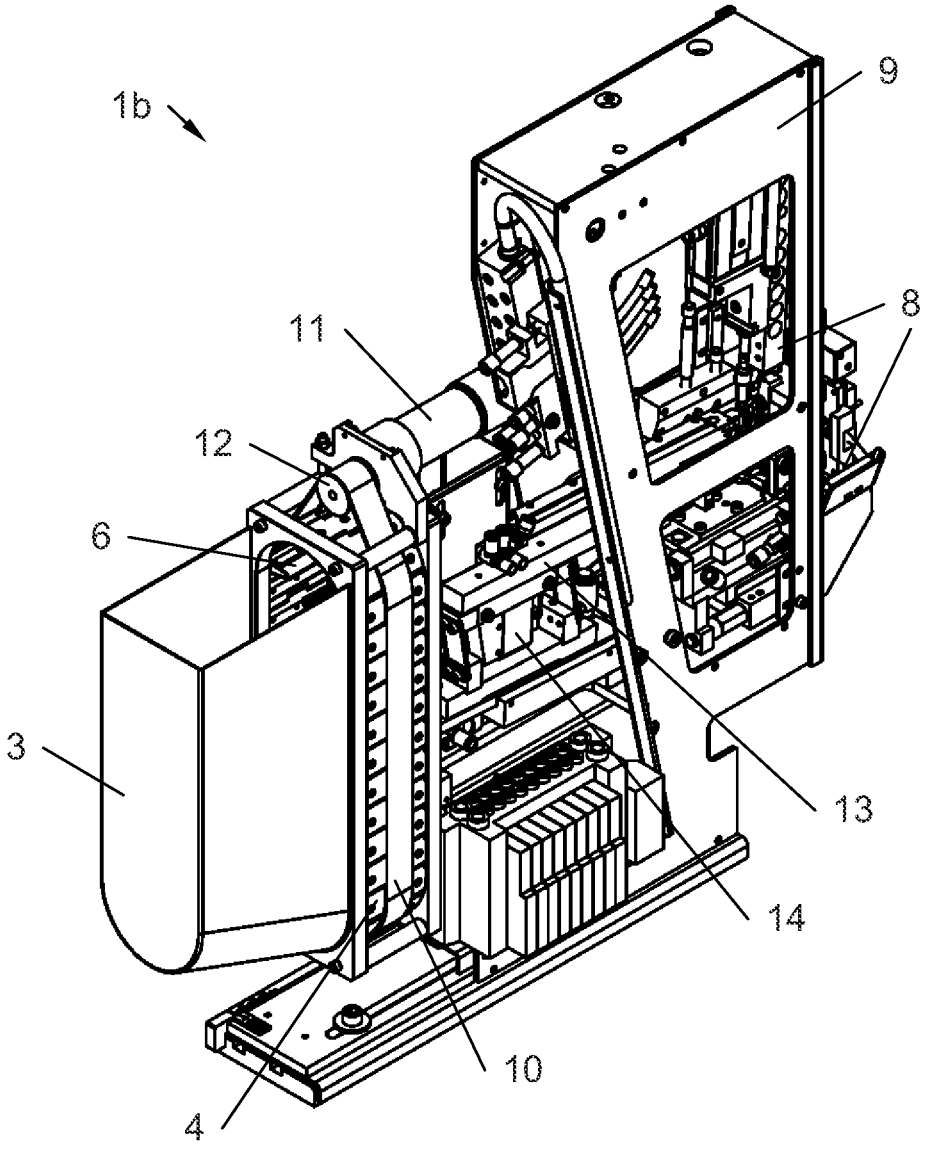
Figure 4:
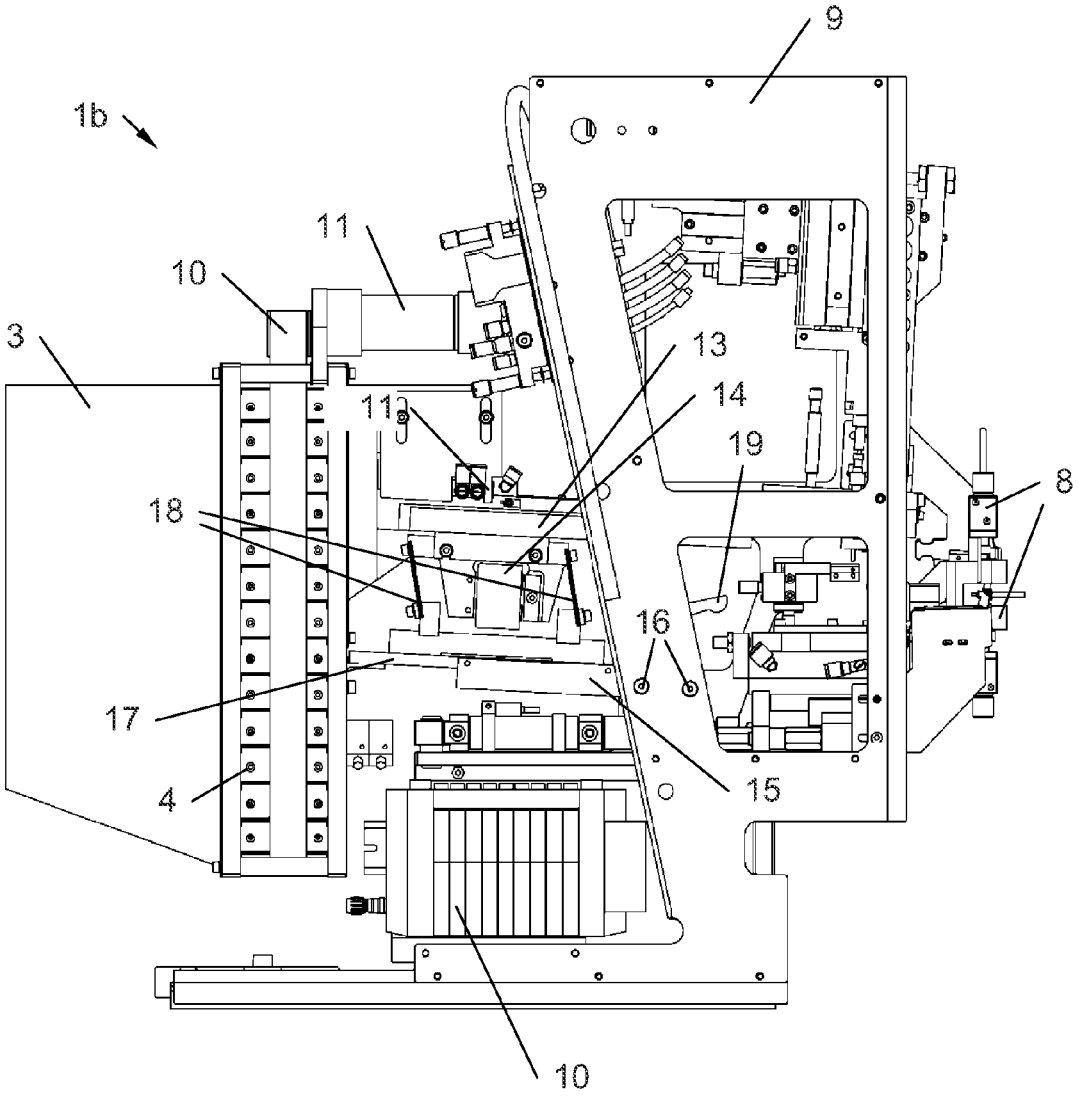
Figure 5:
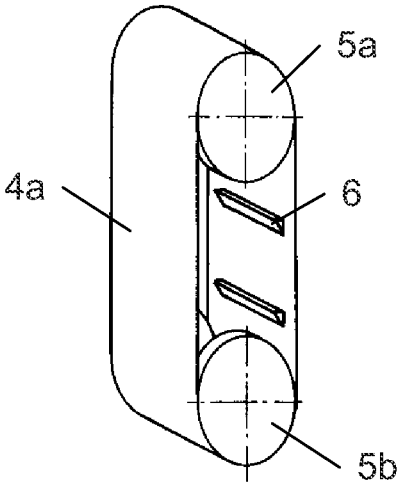
Figure 6:
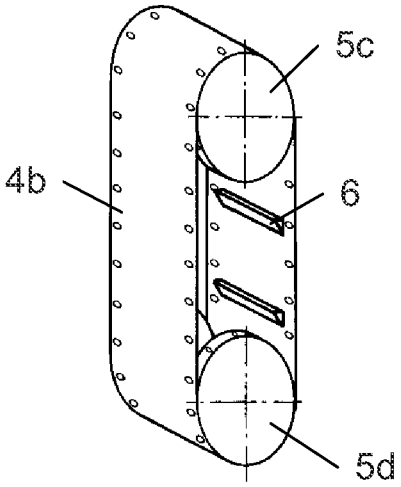
Figure 7:
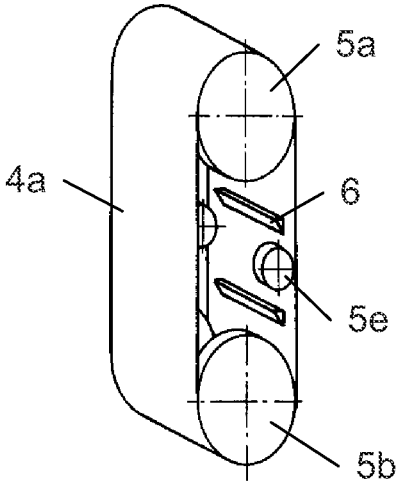
Figure 8:
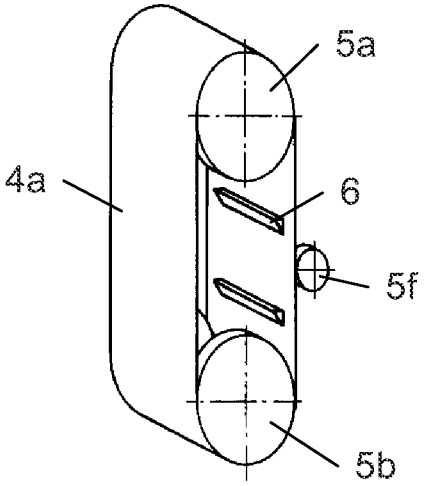
Figure 9:
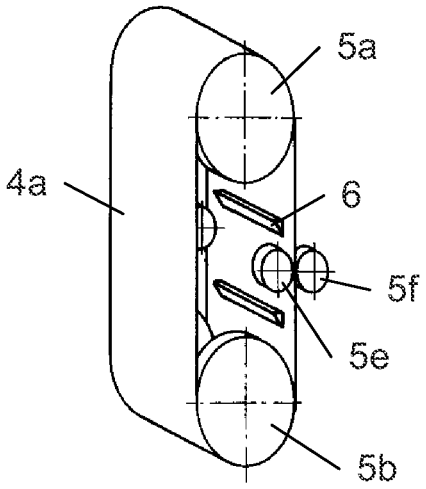
Figure 10:
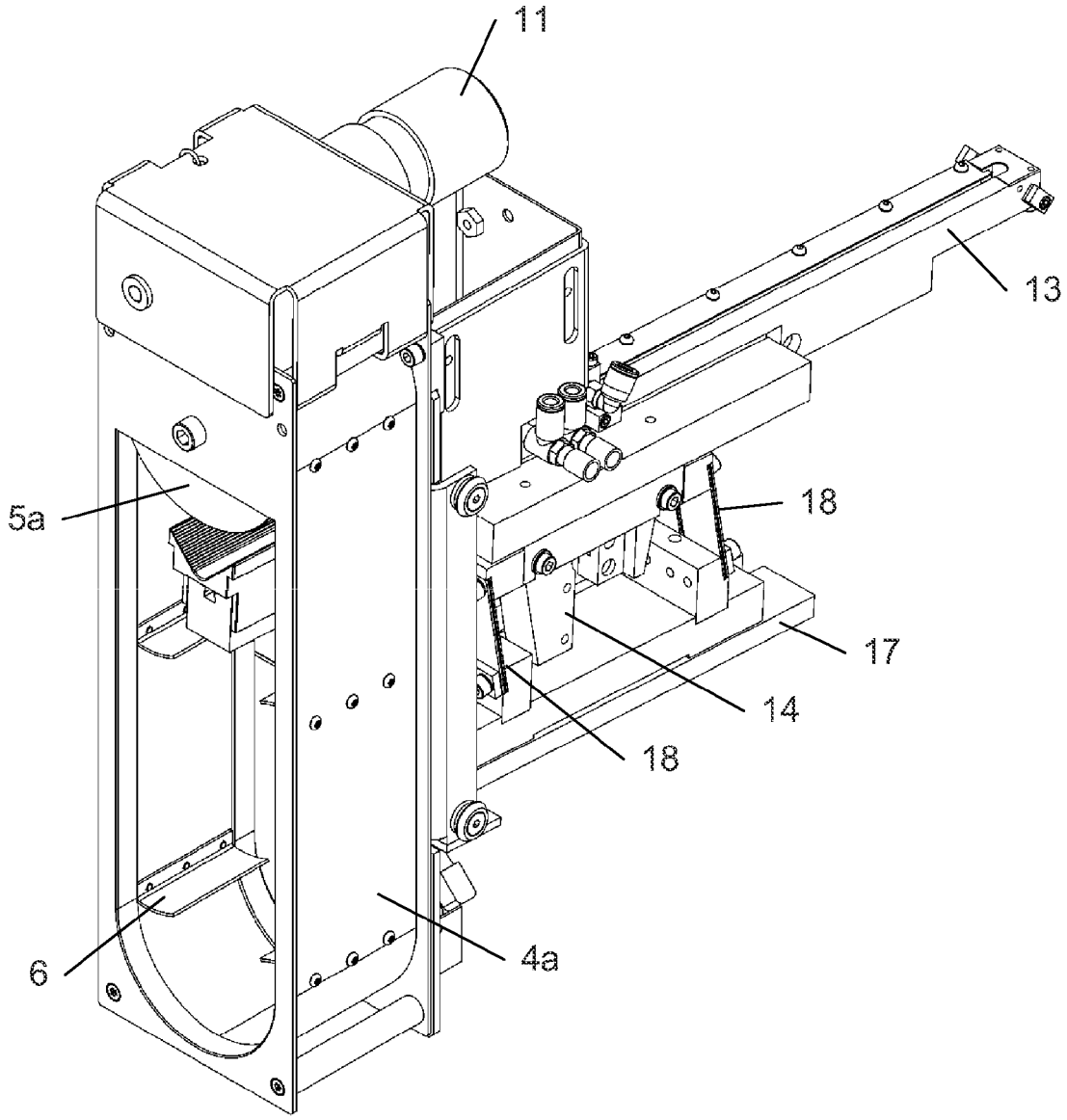
Figure 11:
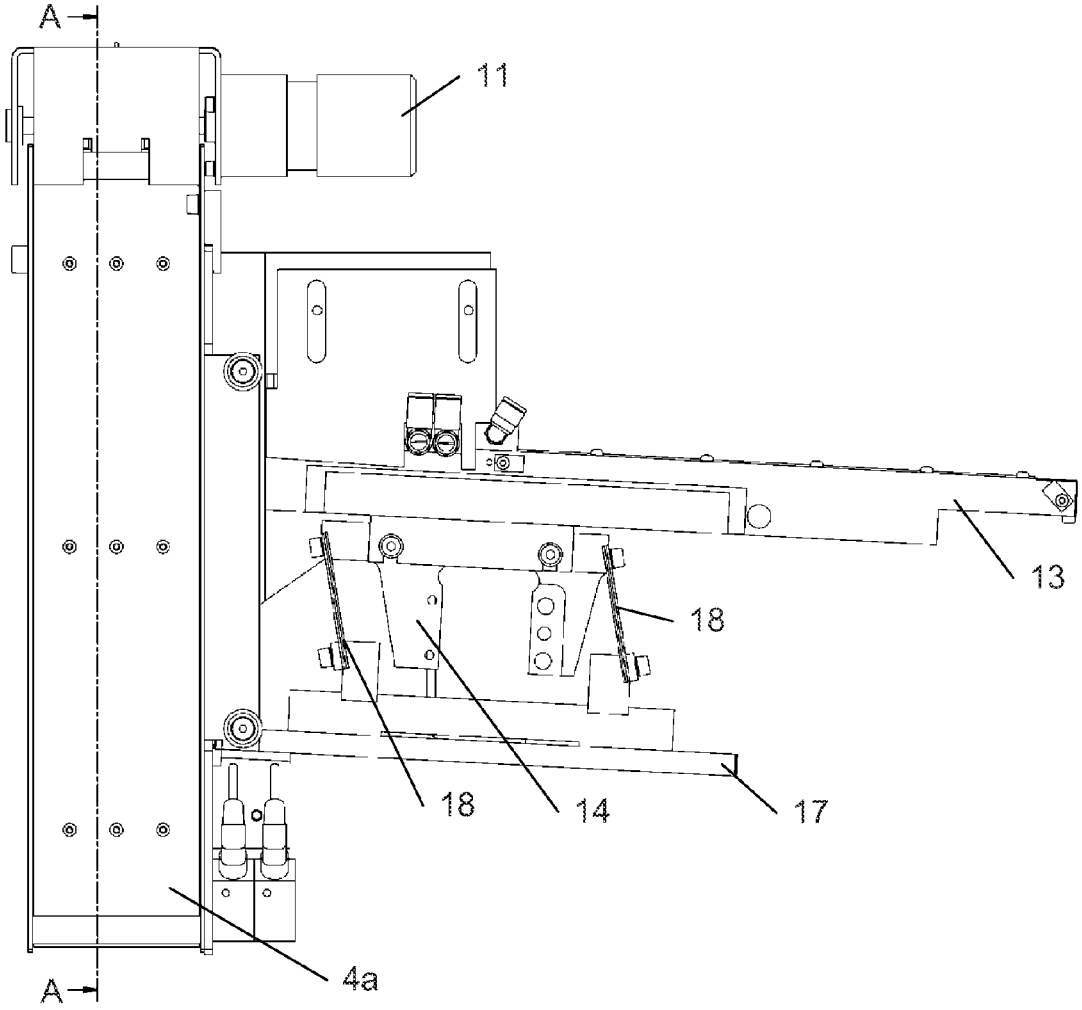
Figure 12:
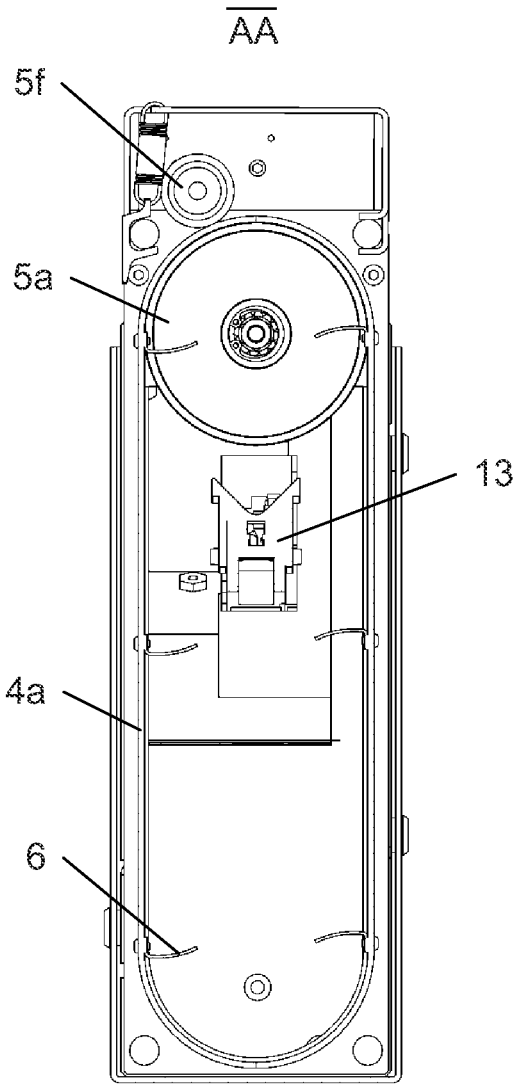
Figure 13:
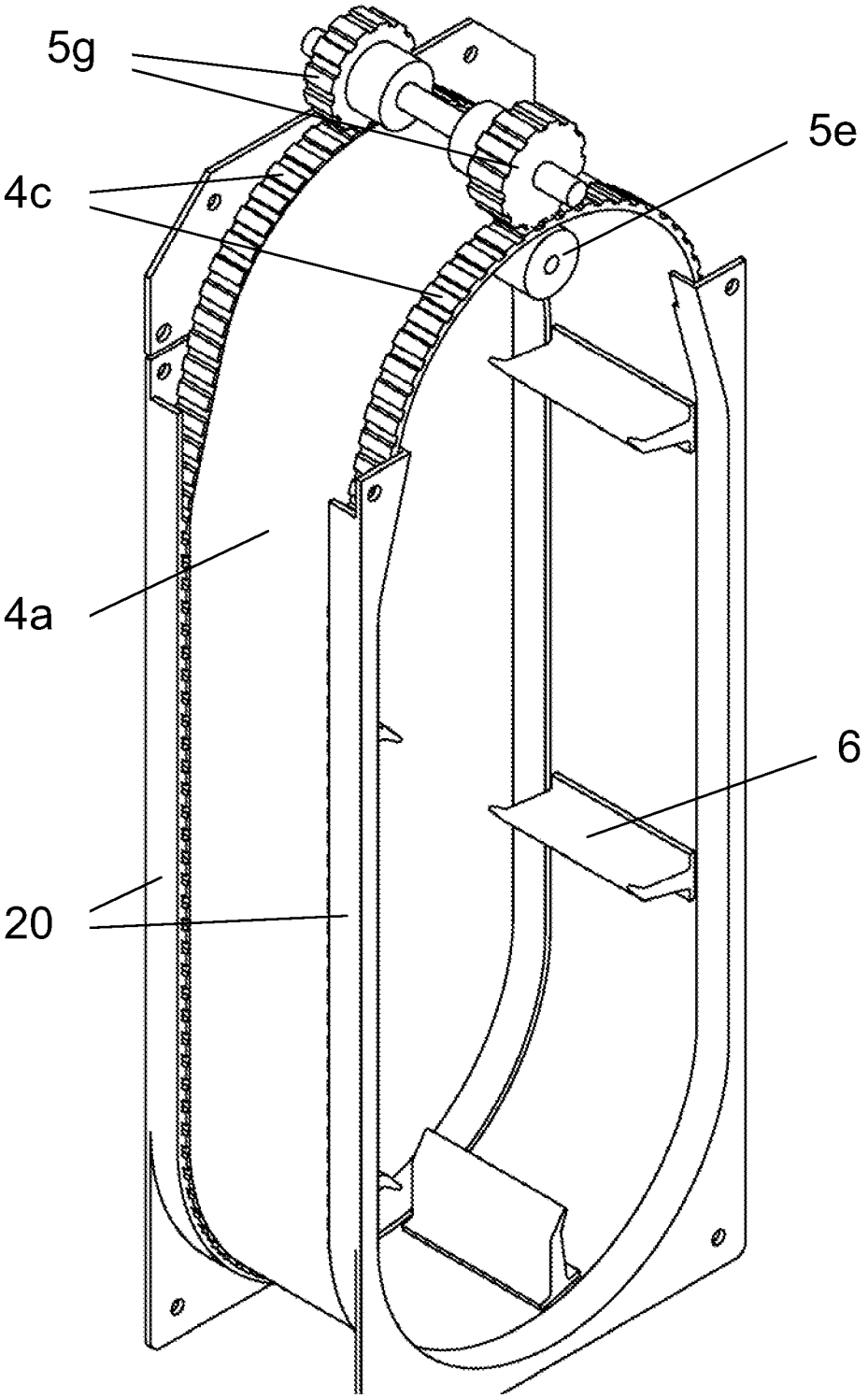
Figure 14:
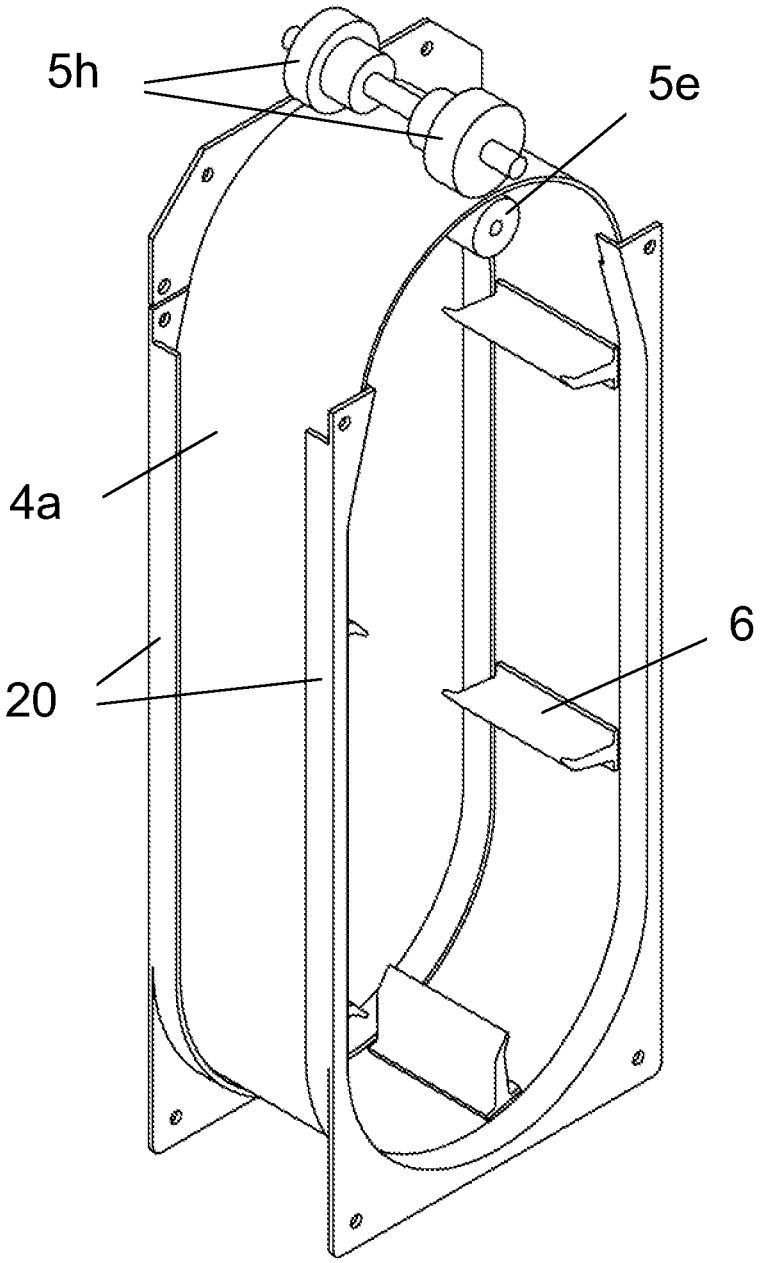
Figure 15:
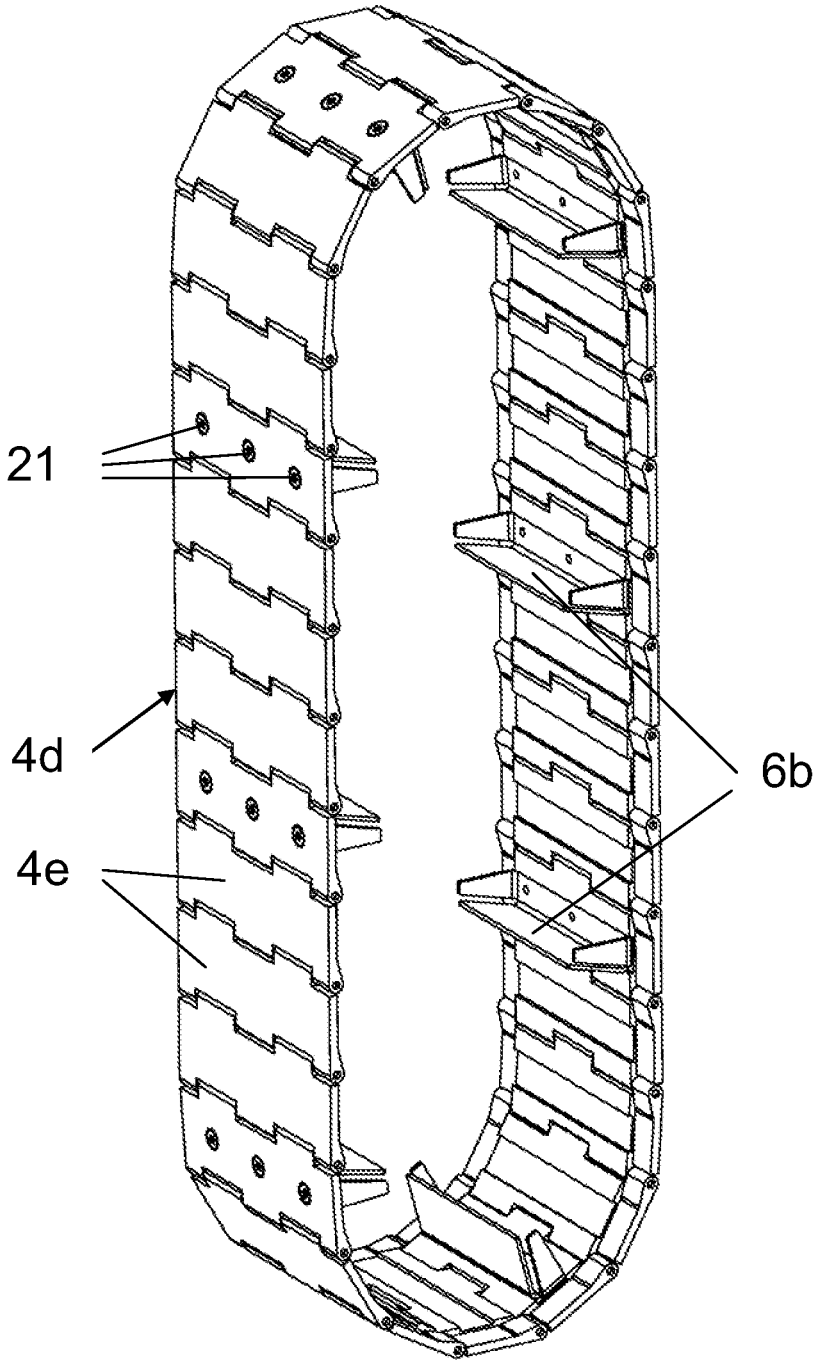
Figure 16:
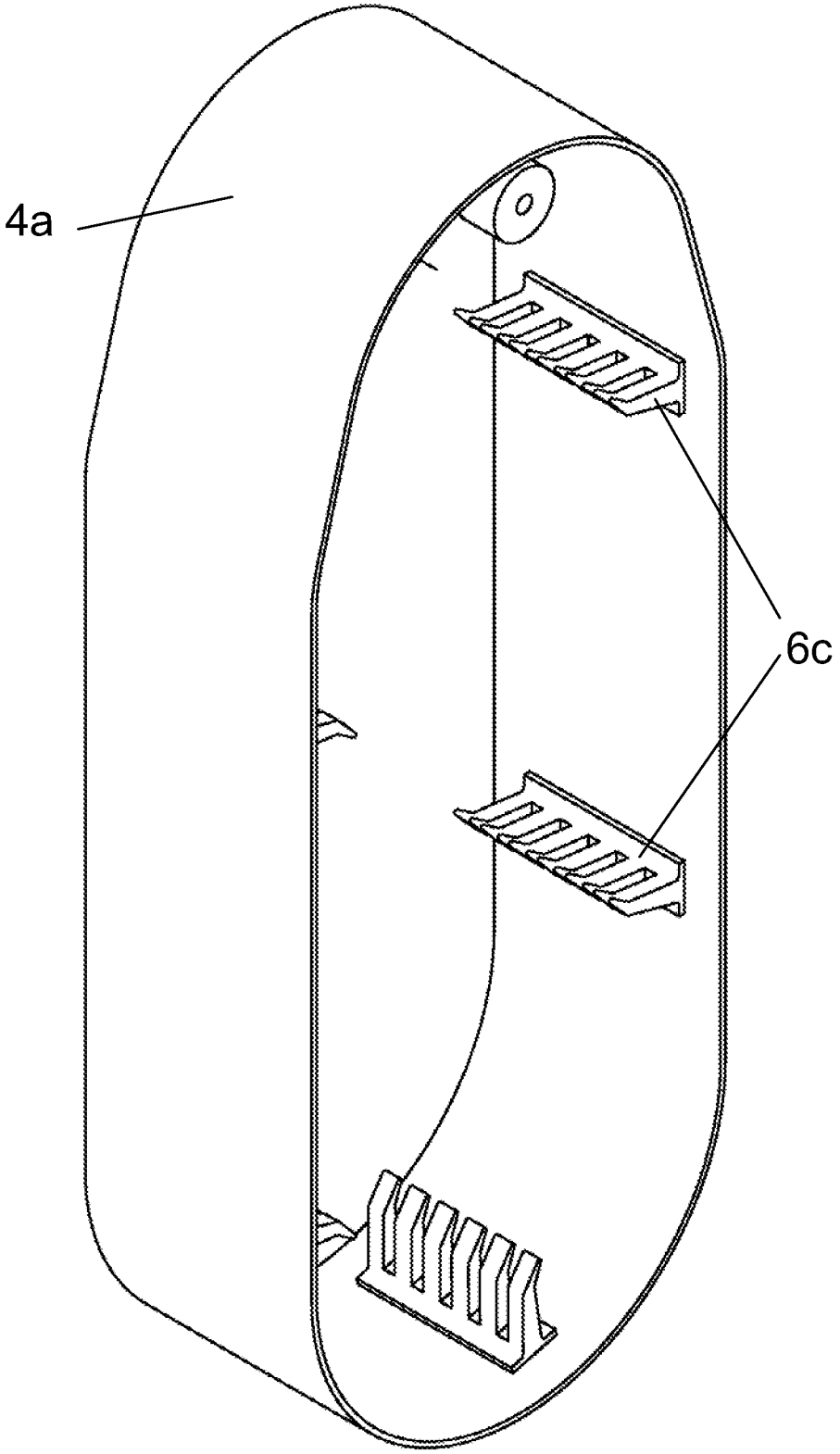

The present invention is explained in more detail hereinafter with reference to exemplary embodiments depicted in the enclosed figures of drawings, in which:

FIG. 1—schematically depicts a simplified version of apparatus according to the invention;

FIG. 2—depicts a practical embodiment of an apparatus according to the invention, obliquely from the front;

FIG. 3—depicts the apparatus of FIG. 2, obliquely from the rear;

FIG. 4—depicts the apparatus of FIGS. 2 and 3, in side view;

FIG. 5—schematically depicts a represented conveyor belt driven via an internal drive roller;

FIG. 6—schematically depicts a perforated conveyor belt driven via one or more internal spiked roller;

FIG. 7—schematically depicts a conveyor belt driven via an internal additional roller;

FIG. 8—schematically depicts a conveyor belt driven via an external additional roller;

FIG. 9—schematically depicts a conveyor belt with an internal and external additional roller;

FIG. 10—depicts a sub-assembly of the apparatus according to the invention with a conveyor belt, obliquely from the rear;

FIG. 11—depicts the subassembly of FIG. 10, in side view;

FIG. 12—depicts the subassembly of FIGS. 10 and 11, in section;

FIG. 13—schematically depicts a conveyor belt driven via a sprocket arrangement, with blades provided as the grommet receivers and a guide rail;

FIG. 14—schematically depicts a conveyor belt driven by a drive roller and counter-roller arrangement;

FIG. 15—shows another version of a conveyor in form of a chain with grommet receiving plates each screwed to one of the elements of said chain; and, FIG. 16—schematically depicts a version with fork-shaped grommet receivers on a continuous belt conveyor.

In the figures of the drawings, parts which are the same and similar are provided with the same reference numerals, and functionally similar elements and features—provided nothing different is set forth—are provided with the same reference numerals but with different indices.

Any reference in this specification to "one embodiment," "an embodiment," "one version," "a version," "a variant," and "one variant," should be understood to mean that a particular feature, structure, or characteristic described in connection with the version, variant, or embodiment is included in at least one such version, variant, or embodiment of the disclosure. Appearances of phrases "in one embodiment", "in one version," "in one variant," and the like in various places in the specification are not necessarily all referring to the same variant, version, or embodiment, nor are separate or alternative versions, variants or embodiments mutually exclusive of other versions, variants, or embodiments. Moreover, various features are described which may be exhibited by some versions, variants, or embodiments and not by others. Similarly, various requirements are described which may be requirements for some versions, variants, or embodiments but not others. Furthermore, as used throughout this specification, the terms 'a', 'an', 'at least,' 'at least one' do not denote a limitation of quantity, but rather denote the presence of at least one of the referenced item, and the term 'a plurality' denotes the presence of more than one referenced items.

FIG. 1 schematically depicts a highly simplified version of a cable grommet fitting apparatus 1*a*. The cable is not shown. The cable grommet fitting apparatus 1*a* includes a loose material container 3 that receives a plurality of loose cable grommets 2, and also includes a conveyor 4 to separate the cable grommets 2 located in the loose material container and to convey these separated cable grommets 2 towards a mounting location.

The apparatus as schematically depicted includes a continuous, annular conveyor 4, a plurality of rollers 5 around which the conveyor 4 is guided, grommet receivers 6 receiving the cable grommets 2, as well as a second conveyor, as slide 7 with conveying portion located slightly obliquely to the horizontal that protrudes inside the ring formed by the conveyor 4. The rollers 5 (in this case two in number) are arranged on the inside of the aforementioned ring and spaced vertically apart. In this case, at least one of the rollers 5 is driven. The grommet receivers 6 are arranged on the conveyor 4 on the inside of the ring. To this end, the rollers 5 have a recess so that the grommet receivers 6 are also able to move past the rollers 5. Naturally, additional guide rollers and/or drive rollers are also possible on the outside of the ring (see also FIGS. 5-9).

When the conveyor 4 is driven by the rollers 5, the grommet receivers 6 are moved through the loose material container 3 and at the same time pick up the cable grommets 2. These cable grommets 2 are lifted upwards, fall in the region of the upper dead center point of the conveyor 4 onto the slide 7, and roll forward to the mounting location. Here they are mounted onto a cable (not shown) by a grommet mounter 8. Naturally, it is also conceivable for the cable grommets 2 to be conveyed in a different position, for example lying flat, to the mounting tool 8.

Instead of the belt depicted here, for example also straps, cables or chains may be considered as the conveyor 4. Instead of the plates shown here, for example also blades, forks or pins may be considered as grommet receivers 6. Instead of the slide 7, which as depicted in the example of FIG. 1 may have a channel, for example a further conveyor belt or a vibrator surface may also be provided as the second conveyor.

FIGS. 2 and 3 depict practical versions of apparatus 1*b* according to the invention obliquely from the front (FIG. 2) and obliquely from the rear (FIG. 3). The apparatus 1*b* includes a frame 9 and a mounting tool 8 attached therein. This grommet mounter 8 is known per se and need not be described in detail. The apparatus 1*b* further includes a loose material container 3 receiving a plurality of loose cable grommets 2, and a conveyor 4 in form of a conveyor chain 4*d* (FIG. 15) to separate the cable grommets 2 located in the loose material container 3, and to convey the separated cable grommets 2 to the mounting tool 8.

It should be understood that instead of the driven roller 5 depicted in FIG. 1 in engagement with the conveyor 4, FIGS. 2-3 depict a drive roller 12 in engagement with a continuous annular drive 10 and driven by a motor 11. In this example, a belt is provided as the drive 10. It is conceivable, however, to use for example a strap, a cable or a chain as the drive 10. The drive 10 is partially in engagement with the conveyor 4 on the outside of the annular ring formed by the conveyor 4. Grommet receivers 6 are attached to the inside of the conveyor 4. In a variant according to FIGS. 2-3, the conveyor 4 may be guided in a rail and not via rollers. In this case, the rail may be generally oval-shaped. Naturally, in such variants it is also conceivable for the conveyor 4 to be guided, as in FIG. 1, alternatively or additionally via rollers 5.

Furthermore, in this example, the previously-referred to horizontal or oblique conveying portion is an extent of a vibrator rail 13 as the second conveyor, this vibrator rail 13 positioned slightly obliquely relative to the horizontal and protruding inside the ring formed by the annular conveyor 4. The vibrator rail 13 is in this case driven by a vibrator motor 14, which sets the vibrator rail 13 in vibration and promotes the conveyance of cable grommets 2.

The function of versions of apparatus according to FIGS. 2 and 3 is similar to the apparatus 1*a* shown in FIG. 1. If the drive 10 is driven by the drive motor 11 via the drive roller 12, it also transmits the movement of the drive 10 to the conveyor 4 (in this case implemented by a chain). In this manner, the grommet receivers 6 are moved through the loose material container 3 and pick up the cable grommets 2 while passing through. These cable grommets 2 are moved upwards and then fall in the region of the upper dead centre point of the conveyor 4 onto the vibrator rail 13, and are subsequently transported by the vibrations thereof to the mounting location. There, they are mounted on a cable (not shown) by a grommet mounter tool 8.

Advantageously, the loose material container 3 and the conveyor arrangement 4,5,6 may form a subassembly. As a result, the conveyor arrangement 4,5,6 may be optimally adapted to the cable grommets 2 located in the respective loose material container 3. For example, round cable grommets 2 may require a different receiver 6 as opposed to rectangular cable grommets; likewise, thin cable grommets may require a different receiver 6 as opposed to thick cable grommets, etc. Preferably, therefore, loose material containers 3 provided with a specific type of cable grommet 2 are combined with a conveying arrangement 4,5,6 specifically adapted to these specific cable grommets 2. Advantageously, in this way, the loose material containers 3 do not need to be emptied when resetting a machine. In this manner, inadvertent combination of poorly matched components and resulting gaps in the conveyed stream associated therewith as well as the jamming of cable grommets 2 associated therewith, are also effectively avoided.

Considering this subassembly of the loose material container 3 and the conveyor assembly 4,5,6 further, it should be understood that the drive belt 10 and the drive motor 11 naturally may also be parts of this subassembly, so that when resetting the apparatus 1*b*, it is possible to dispense with a setup of the drive belt 10. It is also conceivable, however, for example, for the conveyor 4 to be driven via a friction wheel 5*e*,5*f* (see FIGS. 7 and 8). In such a variant, when resetting the apparatus, the conveyor 4 is also simply pressed against the friction wheel 5*e*,5*f*. Finally, the vibrator rail 13 along with its vibrator motor 14 may also be part of the aforementioned subassembly. In this manner, the conveying portion 7,13 may also be optimally adapted to the cable grommets 2 to be conveyed.

FIG. 4 depicts the cable grommet fitting apparatus 1*b* of FIGS. 2 and 3 in side view. In addition to the already described units, in this case an adapter plate 15 connected to the frame 9 by fitting screws 16 may be seen. The subassembly described above is fastened in this example to the frame 9 by its base plate 17 using a clamping lever 19, without a tool, via the adapter plate 15. The base plate 17 carries both the vibrator motor 14 (for example, an electromagnet acting as a linear motor) and the vibrator rail 13 mounted via springs 18. The conveyor 4, the rail in which the conveyor 4 is guided (alternatively or additionally to rollers corresponding to rollers 5 of FIG. 1), the drive 10, the motor 11, the drive roller 12, and the loose material container 3 are fastened via the base plate 17. The aforementioned clamping lever 19 facilitates handling and may preferably be provided on the outer side of the subassembly's side wall, but may also be located at its inner side. Instead of clamping lever 19, also a clamping screw offering the same functionality may be provided.

FIGS. 5-9 depict different exemplary variants of driving the conveyor. More specifically, in FIG. 5, a conveyor belt 4*a*, is driven via an internal drive roller 5*a*. The roller 5*b* is configured as a freewheeling roller. Naturally it is also conceivable for the roller 5*b* to be driven alternatively to the roller 5*a* or additionally thereto. It may also be clearly seen from FIG. 5 that the central region of the conveyor belt 4*a* is preferably free of rollers 5*a*, 5*b* due to the grommet receivers 6.

Considering FIG. 5 in more detail, the drive roller 5*a* is, in this example, configured as a friction roller and/or friction wheel. This drive roller is able to slip in the event of overload, so that damage to the drive motor or a gear mechanism located between the drive roller 5*a* and drive motor may be avoided.

FIG. 6 depicts a variant with a perforated conveyor belt 4*b* that is in engagement with the two drive rollers 5*c*, 5*d* configured as spiked rollers. Naturally, it is possible that only one of the rollers 5*c*, 5*d* may be configured as the drive roller, and in this case, the spikes of the freewheeling roller may then be dispensed with entirely or in part. Advantageously, in this variant a movement of the drive rollers 5*c*, 5*d* may be directly and specifically assigned to a movement of the conveyor belt 4*b*. This provides advantages if a position of the conveyor belt 4*b* is to be determined, for example, from the signal of a step motor or a rotation sensor. Furthermore, contamination of the drive rollers 5*c*, 5*d* or the conveyor belt 4*b*, even oil contamination, may not as easily cause a malfunction of the machine. In this variant, the contact forces of the rollers 5*c*, 5*d* on the conveyor belt 4*b*, when compared to those in a friction wheel drive, may advantageously also be reduced. The mounting of the rollers 5*c*, 5*d* may, therefore, be designed to be less robust. Also, smaller drive motors may be used due to the reduced bearing forces.

FIG. 7 depicts a variant of the invention in which the rollers 5, 5*b*, around which the conveyor belt 4*a* passes, are both configured as freewheeling rollers. The drive is implemented in this case via additional drive roller or rollers 5*e* arranged inside the ring formed by the conveyor belt 4*a*.

FIG. 8 depicts an arrangement very similar to that depicted in FIG. 7. In contrast therewith, external drive rollers 5*f* are provided instead of the drive rollers 5*e* located inside the conveyor belt 4*a* ring. This variant may provide advantages when resetting the machine, for example when a subassembly formed from the conveyor belt 4*a* and the rollers 5*a*,5*b* is simply pressed onto the drive roller 5*e* fixedly connected to the machine, when resetting the machine. Furthermore, as the outside of the ring is free of grommet receivers 6, it may be understood that wider, broader drive rollers 5*f* may be employed, and thus greater drive forces transmitted.

Finally, FIG. 9 depicts a variant wherein the two rollers 5*e*,5*f* are situated opposite one another. In this case, either the internal roller 5*e* or the external roller 5*f* may be driven. Alternatively or optionally, both rollers 5*e*,5*f* may also be driven. With this arrangement, high contact forces of the drive rollers 5*e*,5*f* may be applied to the conveyor belt 4*a*, and thus greater drive forces may be transmitted thereto. Compared to arrangements depicted in FIGS. 7 and 8, where the conveyor belt 4*a* is pressed against a guide rail at least in the region of the drive rollers 5*e*,5*f*, in the variant of FIG. 9 the frictional forces which cause losses may be reduced in this manner.

While the rollers 5*e*,5*f* in FIGS. 7-9 are depicted as friction rollers, it is also conceivable that these rollers be configured as spiked rollers. Generally, the positive drive connection may also be created via at least one gearwheel or sprocket 5*g* that engages in a toothed portion 4*c* of the conveyor belt 4*a*, as depicted in FIG. 13. In such variant, the conveyor belt 4*a* may be configured at least partially as a toothed belt (for example in the region analogous to where the conveyor belt 4*b* of FIG. 6 has the perforation, that is, on both edges of the belt 4*a*). Such gearwheel 5*g* may be arranged as the toothed portion of the conveyor outside, or even inside, the ring formed by the conveyor. Finally, it is also conceivable that the drive rollers 5*a*, 5*b*, 5*e*, 5*f*, 5*g* and/or the drive belt 4*a* are of lightweight construction, for example stamped, in order to improve the frictional connection.

Further considering FIG. 13, the grommet receivers 6 are provided as blades connected to the belt 4*a* by any appropriate method, e.g. welded or glued. Guide rails 20 may be provided for the edges of the belt 4*a* or any other annular conveyor that may be employed, and define the geometrical shape of the annular conveyor 4 as well as stabilize the conveyor in the section with no drive rollers or counter-rollers. FIG. 14 depicts another version of a conveyor arrangement, with drive rollers 5*h* operatively interacting with the edge regions of conveying belt 4*a*, which is guided in guiding rails 20 as explained in connection with FIG. 13.

Another version of conveyor 4 is depicted in FIG. 15. Here, a closed chain 4*d* of pivotally connected elements 4*e* is provided as the annular conveyor 4. Onto some of the elements 4*c*, grommet receivers in form of plates 6*b* are mounted, for example by screws or rivets 21. Instead of plates 6*b* or blades 6, fork-like grommet receivers 6*c* as depicted in FIG. 16 might be provided. Instead of fastening the grommet receivers 6 . . . 6*c* by screws or rivets 21, alternative fixation methods may be employed, for example glueing, welding, soldering, or the like.

FIG. 10 depicts a subassembly of the cable grommet fitting apparatus 1*b*, obliquely from the rear, as an actual module comprising a continuous, annular conveyor 4*a* cooperating with a loose material container (not here shown) with grommet receivers 6 for receiving the cable grommets 2. FIG. 11 similarly depicts this subassembly in side view, while FIG. 12 depicts it in sectional view. As depicted, the receivers 6 are formed in this example by plates and/or blades that are riveted to the conveyor 4*a* formed by a rubber belt. At the upper end of the ring formed by the rubber belt 4*a*, there is a roller 5*a* around which the rubber belt 4*a* is guided and against which a drive roller 5*f*, FIG. 12, acting on the rubber belt 4*a* presses. This drive roller 5*f* is driven by a motor 11 (FIG. 11). At the lower end of the ring formed by the rubber belt 4*a* is located a guide rail, on which the rubber belt 4*a* is guided. Alternatively or additionally, it is conceivable that at the lower end of the ring a roller could be arranged, so that the rubber belt 4*a* is guided around this additional roller. The subassembly further includes a vibrator rail 13, a vibrator motor 14, a base plate 17, as well as two springs 18. The function of these enumerated components is the same as the function of the similarly-enumerated components of the apparatus 1*b* depicted in FIGS. 2-4.

As has been indicated, the variants explicitly set forth only represent a proportion of the many possibilities for the invention and should not be used to limit the field of application of the invention. For the person skilled in the art, it should be straightforward to adapt the invention to requirements, based on the considerations shown here, without departing from the protected scope of the invention.

Moreover, reference is made to the fact that parts of the apparatuses shown in the figures may also form the basis for independent inventions. It should also be understood in the context of the preceding discussion that the present invention is not limited in any manner to the described and drawings-depicted implementations, but may be realized in many forms and dimensions without abandoning the region of protection of the invention. For example, in implementations of the invention the materials that may be employed and also, as well, the dimensions of particular elements, may be according to the demands of a particular construction. Thus, in closing, it should be noted that the invention is not limited to the abovementioned versions and exemplary working examples. Further developments, modifications and combinations are also within the scope of the appended patent claims and are placed in the possession of the person skilled in the art from the present disclosure. Accordingly, the techniques and structures described and illustrated herein should be understood to be illustrative and exemplary, and not necessarily limiting upon the scope of the present invention. The scope of the present invention is defined by the appended claims, including known equivalents and unforeseeable equivalents at the time of filing of this application.

LIST OF REFERENCE LABELS

1*a*, 1*b* cable grommet fitting Apparatus
2 cable grommet
3 loose material container
4, 4*a*, 4*b* conveyor belt
4*c* toothed section of conveyor
4*d* conveyor chain
4*c* element of conveyor chain
5, 5*a* . . . 5*f*, 5*h* roller
5*g* sprocket
6 grommet receiver (blade)
6*a* grommet receiver (plate)
6*c* grommet receiver (fork)
7 slide
8 grommet mounter, mounting tool
9 frame
10 Drive (belt)
11 drive motor
12 drive roller for drive
13 vibrator rail
14 vibrator motor (electromagnetic)
15 adapter plate
16 fitting screw
17 base plate
18 spring
19 clamping lever
20 guide rails
21 screws or rivets

What is claimed is:

1. A cable grommet fitting apparatus comprising:

a cable grommet container configured to receive loose grommets, said cable grommet container having at least one opening;

a conveyor configured to effect supply from said cable grommet container via said at least one opening in said cable grommet container, said conveyor including a driven flexible annular loop member, said driven flexible annular loop member having an inner surface;

at least one grommet receiver, said at least one grommet receiver extending away from the inner surface of said flexible annular loop member and being arranged to inwardly extend from said inner surface into an area circumscribed by a perimeter formed by said inner surface of said flexible annular loop member; and, a grommet mounter being situated at a grommet mounting location so as to be supplied from said cable grommet container by said conveyor.

2. A cable grommet fitting apparatus as claimed in claim 1 further comprising:

at least one roller disposed inside said driven flexible annular loop member, said flexible annular loop member being guided at least partially around said at least one roller.

3. A cable grommet fitting apparatus as claimed in claim 2 further comprising:

a second roller disposed inside said driven flexible annular loop member and spaced from said at least one roller.

4. The cable grommet fitting apparatus as claimed in claim 2 wherein:

said at least one roller is a driven friction roller.

5. The cable grommet fitting apparatus as claimed in claim 2 wherein:

said at least one roller is a driven spiked roller.

6. The cable grommet fitting apparatus as claimed in claim 2 wherein:

said at least one roller is a driven gear wheel.

7. A cable grommet fitting apparatus as claimed in claim 1 further comprising:

a drive roller engaging said annular flexible loop member.

8. The cable grommet fitting apparatus as claimed in claim 7 wherein:

said drive roller engages on said inside of said annular flexible loop member.

9. A cable grommet fitting apparatus as claimed in claim 7 further comprising:

said drive roller engages on an outside of said annular flexible loop member.

10. A cable grommet fitting apparatus as claimed in claim 7 further comprising:

a counter-roller engaging said annular flexible loop member opposite to said drive roller.

11. A cable grommet fitting apparatus as claimed in claim 1 further comprising:

a continuous annular drive operatively connected to said flexible annular loop member; and, a drive roller engaging said continuous annular drive.

12. A cable grommet fitting apparatus as claimed in claim 11 further comprising:

a counter-roller engaging said continuous annular drive opposite to said drive roller.

13. A cable grommet fitting apparatus as claimed in claim 1 further comprising:

a guide rail configured to guide said conveyor.

14. A cable grommet fitting apparatus as claimed in claim 1 further comprising:

a second cable grommet conveyor extending into said flexible annular loop member.

15. The cable grommet fitting apparatus as claimed in claim 14 wherein:

said second cable grommet conveyor is selected as at least one of the group consisting of a slide, a conveyor belt, and a vibrator.

16. The cable grommet fitting apparatus as claimed in claim 1 wherein:

said driven flexible annular loop member is selected as at least one of the group consisting of a belt, and a chain.

17. The cable grommet fitting apparatus as claimed in claim 1 wherein:

said at least one grommet receiver is selected as at least one of the group consisting of a blade, a fork, and a plate.

18. A cable grommet fitting apparatus as claimed in claim 1 further comprising:

said flexible annular loop member includes a resilient belt; and, a plurality of grommet receivers, each of said plurality of grommet receivers being a respective plastic blade.

19. The cable grommet fitting apparatus as claimed in claim 18 wherein:

at least one of said plastic blades being adhesively bonded to said resilient belt.

20. The cable grommet fitting apparatus as claimed in claim 18 wherein:

at least one of said plastic blades being riveted to said resilient belt.

* * * * *